US008764292B2

(12) United States Patent
Sturgis

(10) Patent No.: US 8,764,292 B2
(45) Date of Patent: Jul. 1, 2014

(54) ARTICLE FOR HOLDING PRODUCT AND METHODS

(75) Inventor: Sheldon Sturgis, Minneapolis, MN (US)

(73) Assignee: Performance Seed, St. Cloud, MN (US)

( * ) Notice: Subject to any disclaimer, the term of this patent is extended or adjusted under 35 U.S.C. 154(b) by 871 days.

(21) Appl. No.: 12/274,929

(22) Filed: Nov. 20, 2008

(65) Prior Publication Data

US 2010/0124386 A1 May 20, 2010

(51) Int. Cl.
*B65D 33/08* (2006.01)

(52) U.S. Cl.
USPC ..... 383/10; 383/7; 383/116

(58) Field of Classification Search
USPC ..... 383/10, 20, 28, 17; 229/117.14, 117.17, 229/117.09, 117.15; 53/424; 211/85.15; D9/702, 704, 720
See application file for complete search history.

(56) References Cited

U.S. PATENT DOCUMENTS

| | | | |
|---|---|---|---|
| 421,160 | A | 2/1890 | Burbridge et al. |
| 619,564 | A | 2/1899 | Grimball |
| 1,596,355 | A | 8/1926 | Hirsch |
| 1,649,976 | A | 11/1927 | Pomeranz |
| 1,897,438 | A | 2/1933 | Mykol |
| 2,664,131 | A | 12/1953 | Miller |
| 2,789,728 | A | 4/1957 | Britton |
| 2,951,628 | A | 9/1960 | Grussen |
| 2,999,627 | A | 9/1961 | Reinhardt |
| 3,083,876 | A | 4/1963 | Schneider et al. |
| 3,309,008 | A | 3/1967 | Huck |

(Continued)

FOREIGN PATENT DOCUMENTS

| | | |
|---|---|---|
| EP | 0132484 | 2/1985 |
| EP | 0258679 | 3/1988 |

(Continued)

OTHER PUBLICATIONS

PCT International Search Report and Written Opinion from International Application No. PCT/US02/02224, corresponding to U.S. Appl. No. 09/772,189, mailed Jan. 22, 2003, pp. 1-8.

(Continued)

*Primary Examiner* — Gary Elkins
*Assistant Examiner* — Christopher Demeree
(74) *Attorney, Agent, or Firm* — Pauly DeVries Smith & Deffner, LLC

(57) ABSTRACT

The present invention relates to articles such as bags and related methods. In an embodiment, the invention includes an article including a first sheet, a second sheet coupled to the first sheet defining an interior volume between the first sheet and the second sheet, and a handle region defining an aperture passing through the first sheet and the second sheet. The handle region including a first flap and a second flap, the first flap coupled to the first sheet and the second sheet along a first axis, the second flap coupled to the first sheet and the second sheet along a second axis, the first axis and second axis perpendicular to one another, the first flap and the second flap configured to flex away from the handle region. In an embodiment, the invention includes a method of forming a bag including coupling a first sidewall to a second sidewall to form a rectangular bag with four corners and forming a cut pattern through the first sidewall and the second sidewall to form a handle, the pattern outlining the shape of a plurality of flaps that can each flex along separate axes. Other embodiments are also included herein.

10 Claims, 11 Drawing Sheets

(56) References Cited

U.S. PATENT DOCUMENTS

| | | | | |
|---|---|---|---|---|
| 3,348,760 | A * | 10/1967 | Hinsken et al. | 383/9 |
| 3,521,807 | A | 7/1970 | Weisberg | |
| 3,722,785 | A | 3/1973 | Rivman | |
| 3,858,789 | A | 1/1975 | Verbeke | |
| 3,944,033 | A | 3/1976 | Simson | |
| 4,118,912 | A | 10/1978 | Verbeke | |
| 4,196,762 | A | 4/1980 | Goodwin et al. | |
| 4,216,899 | A | 8/1980 | Kamp | |
| 4,438,967 | A | 3/1984 | Fox | |
| 4,558,896 | A | 12/1985 | Farnworth | |
| 4,590,640 | A | 5/1986 | Enersen | |
| 4,643,945 | A | 2/1987 | Kiang | |
| 4,753,489 | A | 6/1988 | Mochizuki | |
| 4,911,562 | A | 3/1990 | Mazzeschi | |
| 4,946,065 | A | 8/1990 | Goulter et al. | |
| 4,953,708 | A | 9/1990 | Beer et al. | |
| 4,971,453 | A | 11/1990 | Rantanen | |
| 4,978,025 | A | 12/1990 | Fougeres | |
| 5,033,868 | A | 7/1991 | Peppiatt | |
| 5,251,982 | A | 10/1993 | Stenstrom et al. | |
| 5,378,065 | A | 1/1995 | Tobolka | |
| 5,437,406 | A | 8/1995 | Gordon et al. | |
| 5,445,109 | A | 8/1995 | Gray et al. | |
| 5,558,438 | A | 9/1996 | Warr | |
| 5,593,229 | A | 1/1997 | Warr | |
| 5,782,562 | A | 7/1998 | Anspacher | |
| 5,882,120 | A | 3/1999 | Bell | |
| 6,053,635 | A | 4/2000 | Anderson et al. | |
| 6,079,877 | A * | 6/2000 | Chew | 383/8 |
| 6,234,946 | B1 | 5/2001 | Fricano | |
| 6,276,579 | B1 | 8/2001 | DeLoach | |
| 6,923,574 | B2 | 8/2005 | Siegel | |
| 7,090,272 | B2 | 8/2006 | Novakovich et al. | |
| D606,419 | S | 12/2009 | Sturgis | |
| 2008/0011818 | A1 * | 1/2008 | Chen | 229/117.01 |

FOREIGN PATENT DOCUMENTS

| | | |
|---|---|---|
| EP | 0368757 | 5/1990 |
| EP | 0370957 | 5/1990 |
| EP | 0524487 | 1/1993 |
| EP | 0630822 | 12/1994 |
| FR | 2529528 | 1/1984 |
| GB | 1598843 | 9/1981 |
| GB | 2171077 | 8/1989 |
| JP | 023955 | 1/1989 |
| JP | 6423955 | 1/1989 |
| JP | 0226460 | 10/1991 |
| JP | 3226460 | 10/1991 |
| JP | 3242156 | 10/1991 |
| JP | 4311457 | 11/1992 |
| WO | WO-0069738 | 11/2000 |
| WO | WO-02060764 | 8/2002 |

OTHER PUBLICATIONS

File History for U.S. Appl. No. 09/772,189, Entitled "Bag with Ergonomically Disposed Handle" (pp. 1-503).

U.S. Appl. No. 29/328,235, Entitled "Bag with Handle" (pp. 1-8).

Lingle, Rick, "A better handling bag", *Packaging World Magazine* packworld.com Oct. 1, 2001, pp. 1-2.

Performance Seed, "Bag with Cut-Out Flaps", p. 1 (prior to Nov. 20, 2007).

Uknown, "Stand-up Pouches 2002 Provided the Stage for Innovative Pouch Designs, Applications, Introductions", www.packstrat.com Jun. 30, 2002, pp. 1-4.

* cited by examiner

ARTICLE FOR HOLDING PRODUCT AND METHODS

FIELD OF THE INVENTION

The present invention relates to articles such as bags and related methods. More specifically, the present invention relates to articles for holding a particulate product and related methods.

BACKGROUND OF THE INVENTION

Dry particulate products such as bird seed, grass seed, water softener salt, and pet food are often sold by retailers in prefilled bags. Such bagged products can be quite heavy depending on their volume, sometimes weighing 50 pounds or more. It can be difficult to grip such bags because of their shape and because they are often made of a relatively slick plastic material. As such, because of both weight and difficulty in gripping, it can be difficult for consumers to manipulate such bagged products.

Such bagged products can also be problematic for retailers because of their propensity to rupture, leading to messy spills of the product contained therein. The shear weight of the product contained therein places unique demands on bag construction that are quite distinct from that of other types of bags such as grocery bags or common retailer bags.

Unfortunately, cost constraints make it difficult to solve these issues. Even adding pennies of additional cost to a bag design can render it unfeasible for use with near-commodity bagged products sold in mass-market retailers.

Accordingly, a need remains for articles for holding dry particulate products.

SUMMARY OF THE INVENTION

The present invention relates to articles for holding a product and related methods. In an embodiment, the invention includes an article including a first sheet, a second sheet coupled to the first sheet defining an interior volume between the first sheet and the second sheet, and a handle region defining an aperture passing through the first sheet and the second sheet. The handle region including a first flap and a second flap, the first flap coupled to the first sheet and the second sheet along a first axis, the second flap coupled to the first sheet and the second sheet along a second axis, the first axis and second axis perpendicular to one another, the first flap and the second flap configured to flex away from the handle region.

In an embodiment, the invention includes a bag including a first sidewall, a second sidewall coupled to the first sidewall defining an interior volume between the first sheet and the second sheet, and a die-cut handle. The die-cut handle including a first flap and a second flap, the first flap coupled to the first sidewall and the second sidewall along a first axis, the second flap coupled to the first sidewall and the second sidewall along a second axis, the first axis and second axis perpendicular to one another. The first and second flaps configured to flex between a closed position where the flaps are substantially planar with the first and second sidewall and an open position where the flaps are not-planar the first and second sidewall.

In an embodiment, the invention includes a method of forming a bag including coupling a first sidewall to a second sidewall to form a rectangular bag with four corners and forming a cut pattern through the first sidewall and the second sidewall to form a handle, the pattern outlining the shape of a plurality of flaps that can each flex along separate axes.

Figure 1:
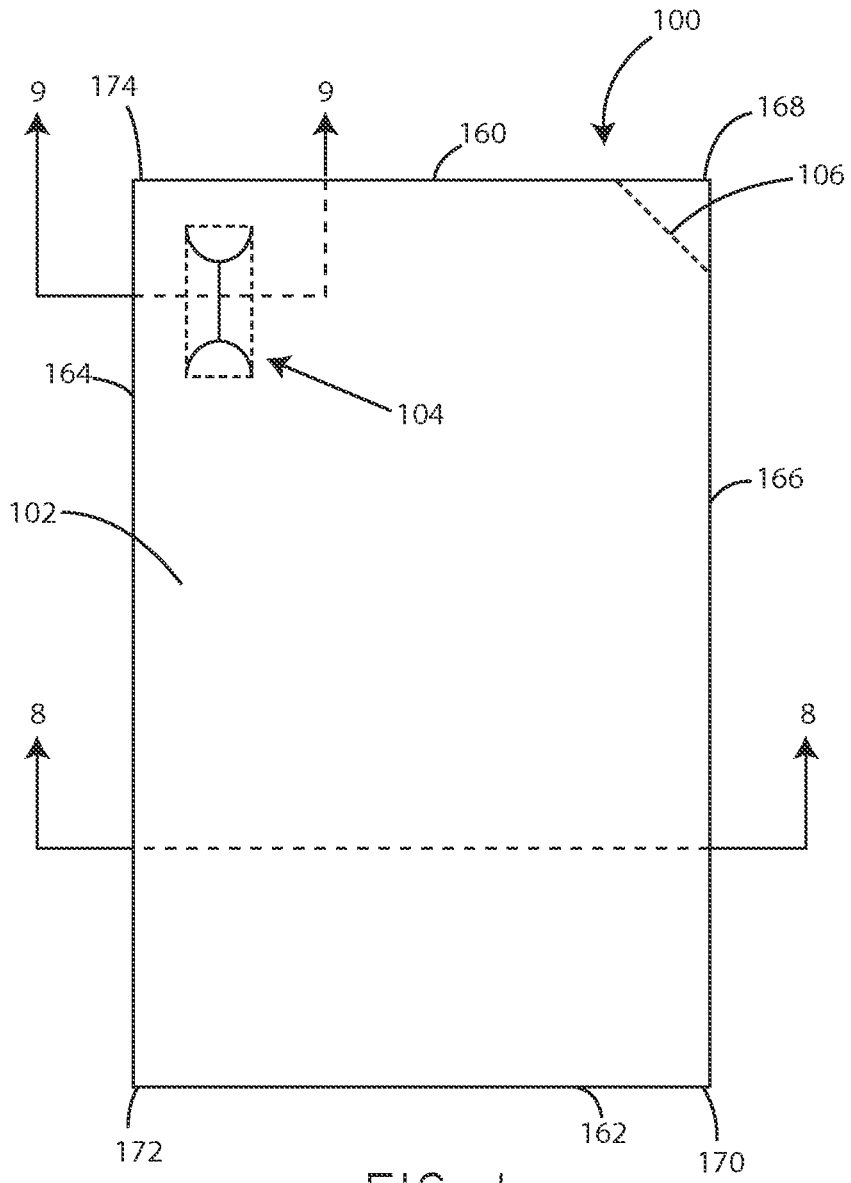
FIG. 1 is a schematic view of an article in accordance with an embodiment of the invention.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

It can be difficult for customers to grip and manipulate bagged products, such as bagged bird seed or grass seed, because of the shape and weight of the filled bags, and also because the bags are often made of a relatively slick plastic material.

In some cases, handles have been attached to such bags in order to make them easier to manipulate for retail customers. However, because of the weight the bags, and because such handles generally result in concentrating the force of the bag weight over a small area of the hand, using handles can result in significant discomfort for bag users.

In addition, where bags have included handles, they are traditionally placed over the center of the bag. However, center placement is not an ideal placement of a handle for the purpose of pouring product, particularly a heavy product. A center-placed handle will increase the stress on the hand and wrist in the lifting and pouring of dry product, because the wrist must be cocked to approximately a 30 degree angle in order to elevate and handle packages with center-placed handles.

In some embodiments herein, a handle is formed in an article, such as a bag, in a manner so as to make the handle more comfortable for use. It has been observed that discomfort arises in an acute manner particularly where a cut edge of bag material is driven into the hand of the user by the overall weight of the bag and the product contained therein. In various embodiments herein, multiple flaps are used to make the handle more comfortable to use. Specifically, in various embodiments, the handle is formed such that flaps of bag material prevent a cut edge of bag material from contacting the hand of a user. The flaps of bag material can flex away from the plane of the package when a user inserts their hand into the handle, such that the edges of the flaps that are still connected to the rest of the package come in contact with the user's hand, instead of a cut edge of the bag. The use of flaps in this manner can lead to increased comfort on the part of the consumer picking up and/or carrying the bag, particularly in the context of bags loaded with a heavy product.

In some embodiments herein, two-layer laminate materials are used to construct articles, such as bags, that can be used to hold dry particulate products such as bird seed, grass seed, and the like. As such, some embodiments herein include an article as described herein in combination with a dry particulate product disposed within the article. Two-layer laminate materials can offer advantages in terms of product strength and/or product appearance. However, the use of such materials can be complicated by the varying properties each layer of the laminate. By way of example, a two-layer laminate of including a first layer of polyester, polyethylene, polypropylene or polyamide (e.g., nylon) and a second layer of polyethylene can be advantageous because it offers significant strength and can allow for an smooth and aesthetic outer surface while maintaining high strength. However, depending on the specific polymer or polymer alloy used in the laminate, the outer layer may not be conducive to heat-sealing. As such, use of such a laminate in a heat-sealed bag that has sufficient strength against rupture, particularly along seams or along tears or perforations in the structure, presents challenges.

However, embodiments of the invention herein include an article that incorporates a two-layer laminate into a heat-sealed bag in a manner that provides the advantages of two-layer laminates along with sufficient strength to resist ruptures along seams or along tears or perforations in the structure including in the area of the bag handle.

While not intending to be bound by theory, it is believed the bag can be made more ergonomic by placing the handle near a corner. Specifically, the placement of the handle near a corner of the package can make it easier to handle and pour the product. In some embodiments, the handle is positioned in a corner of the bag.

Various aspects of exemplary embodiments of the invention will now be described in greater detail. Referring now to FIG. 1, a schematic view of an article in accordance with an embodiment of the invention is shown. The article 100 includes a body 102 having a top edge 160, a bottom edge 162, a first side edge 164, and a second side edge 166. The article 100 also include a first corner 168, second corner 170, third corner 172, and fourth corner 174. In this embodiment, the body 102 of the article 100 is rectangular in shape. However, it will be appreciated that the body 102 can also take on other shapes such as semi-rectangular, square, semi-square, oblong, semi-rounded or the like. The article can include a handle region 104. The handle region 104 can facilitate gripping of the article 102. In some embodiments, the article 102 can also include a pouring region 106. In some embodiments, the pouring region 106 can be defined by a scored line. The pouring region 106 can be adjacent to one end of the top edge 160, while the handle region 104 can be adjacent to the opposite end of the top edge 160.

Figure 2:
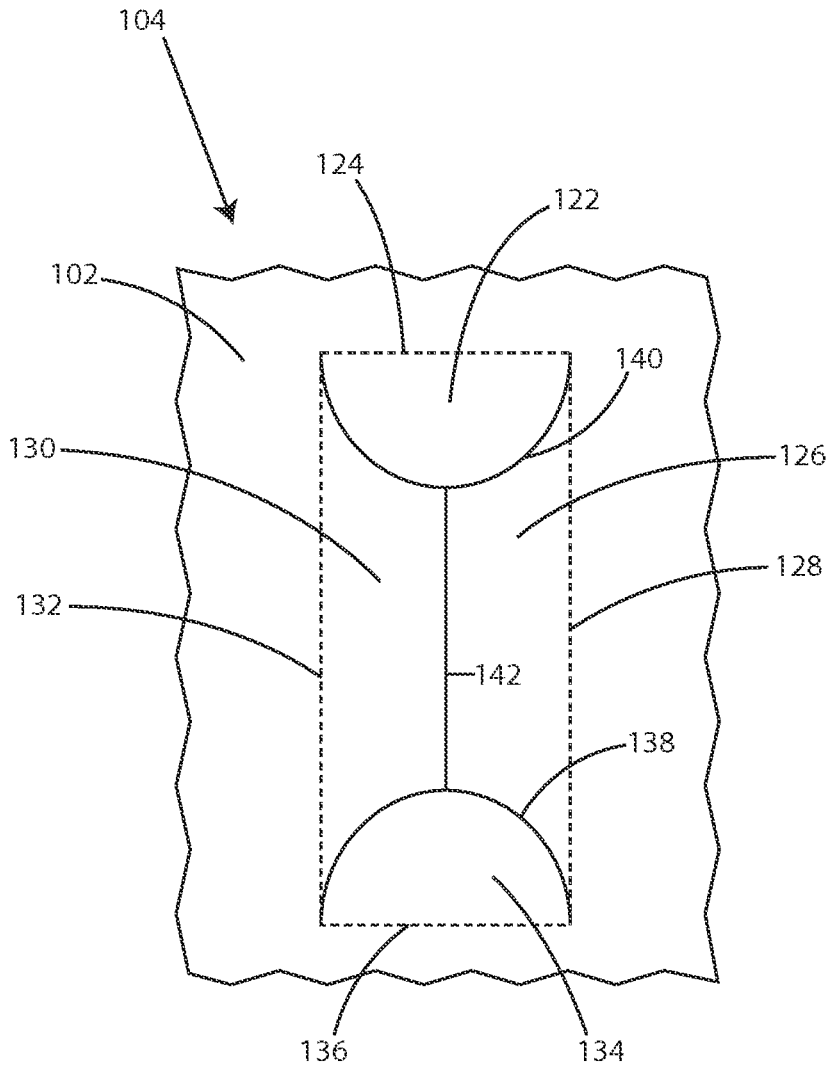
FIG. 2 is an enlarged schematic view of the handle region of the article shown in FIG. 1.

Referring now to FIG. 2, an enlarged schematic view of the handle region 104 is shown. The handle region 104 can be configured to facilitate comfortable gripping of the article 102. In some embodiments, the handle region 104 can include cut lines 138, 140, and 142 that allow multiple flaps of material to flex away when a person's hand is inserted into the handle, creating a tactile feeling of increased comfort for the bag user. Cut lines 138, 140, and 142 can allow flaps 122, 126, 130, and 134 to move independently from one another. For example, when a person's hand is inserted, flap 122 can bend away from the plane of the body 102 along a first axis (line 124) and flap 126 can bend away from the body 102 along a second axis (line 128). In some embodiments, the first axis can be perpendicular to the second axis. Flap 130 can bend away from the body 102 along a third axis (line 132) and flap 134 can bend away from the body 102 along a fourth axis (line 136). In use, the weight of the bag will be supported by the user's hand through contact with the non-cut edge of the flaps that is still connected to the rest of the bag (e.g., the user's hand will support the weight by contact with the bag along one or more of the first axis, second axis, third axis, and fourth axis). In this manner, the flaps 122, 126, 130, and 134 can serve to prevent the user's hand from supporting the weight of the bag through contact with a cut-edge of the material of the body 102, thereby increasing comfort.

Figure 3:
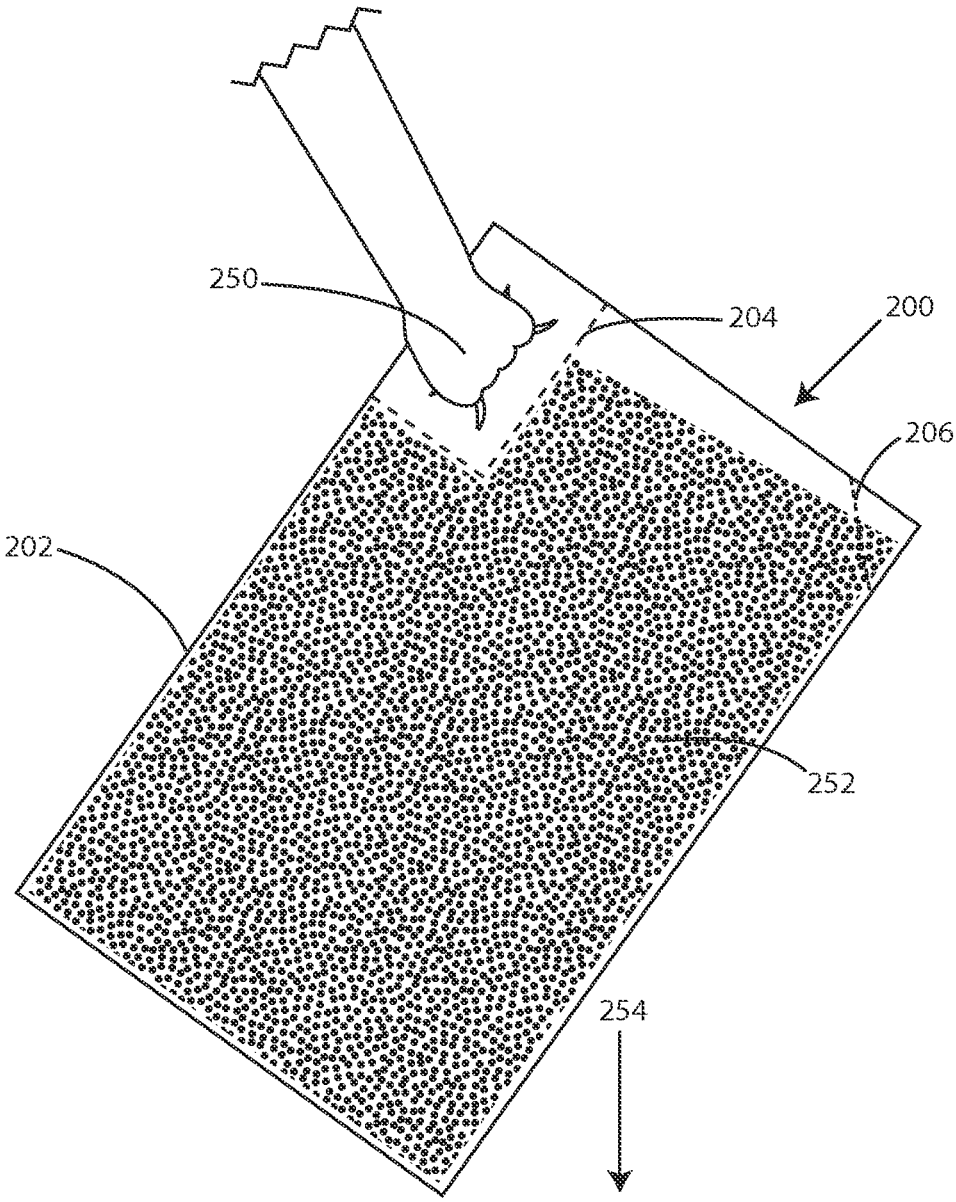
FIG. 3 is a schematic view of the hand of a user manipulating an article in accordance with an embodiment of the invention.

FIG. 3 is a schematic view of the hand 250 of a user manipulating an article in accordance with an embodiment of the invention. In this view, the article 200 includes a body 202 with a particulate product 252 disposed therein. The article 200 also includes a pouring region 206 that can include a perforation line to facilitate opening of the pouring region 206. When a user's hand 250 is inserted into the handle region 204, the article 200 is tilted with respect to the direction of gravity 254 because of the weight of the particulate product 252. As such, when in a carrying position, the handle region 204 of the article 200 is disposed at the highest point of the article 200.

Figure 4:
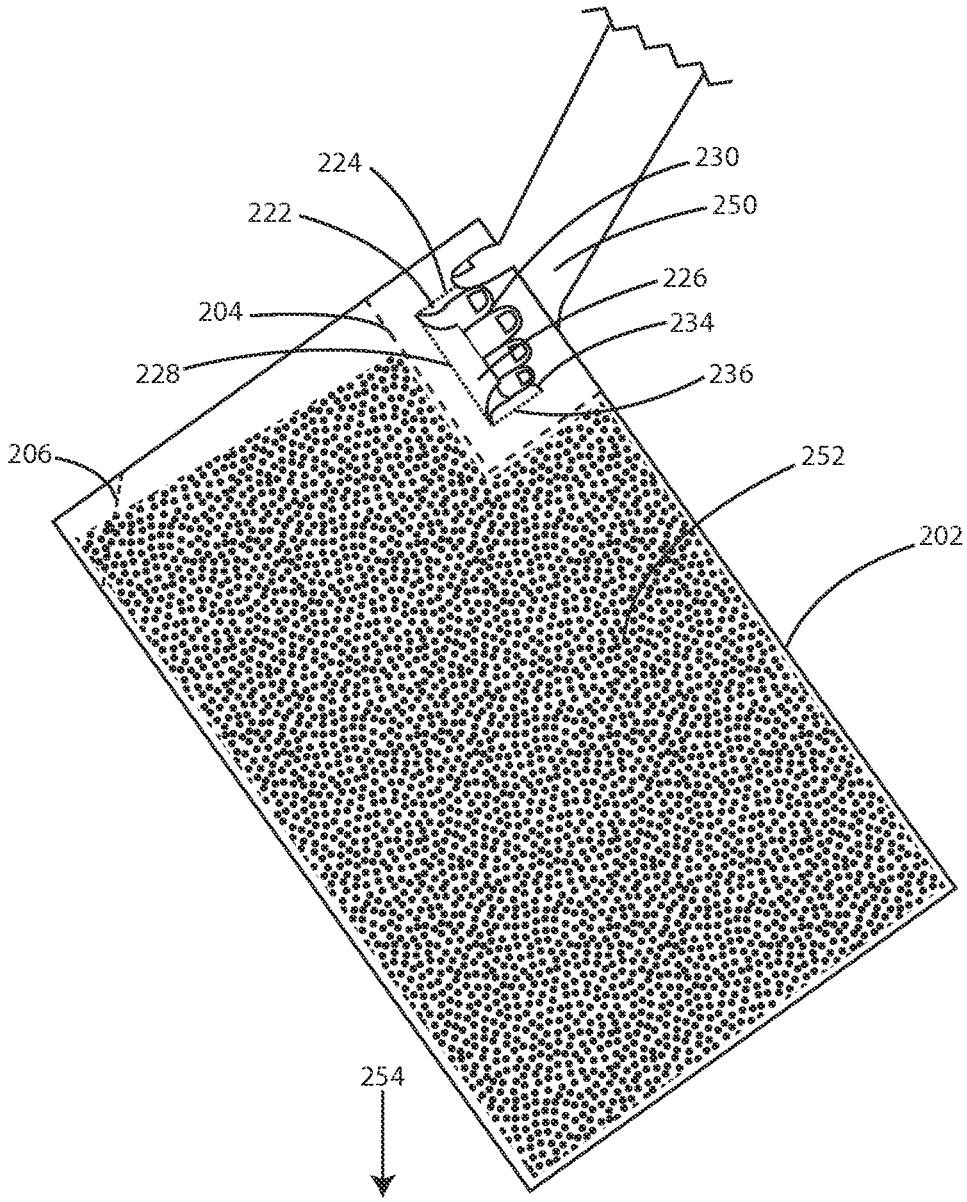
FIG. 4 is an opposite side view of the embodiment shown in FIG. 3.

FIG. 4 is an opposite side view of the embodiment shown in FIG. 3. This view shows the flaps 222, 226, 230 and 234 bent backward because of the insertion of the user's hand 250. In this manner, pressure on the user's hand 250 exerted by the force of gravity acting on the weight of the particulate material 252 contained in the article 200 is distributed across the portion of the flaps that contacts the rest of the article 200 and is bent. In this particular carrying position, the weight of particulate material 252 would mostly be supported by the user's hand as it contacts flap 224 and flap 230. As such, this configuration of the handle region 204 prevents the entire load being supported against the user's hand 250 through contact with a cut-edge, leading to increased comfort for the user.

Figure 5:
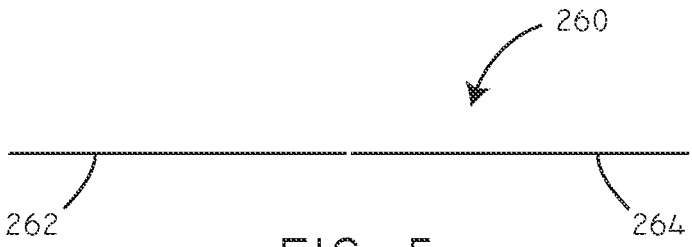
FIG. 5 is a cross-sectional schematic view of two flaps in a closed configuration.
Figure 6:
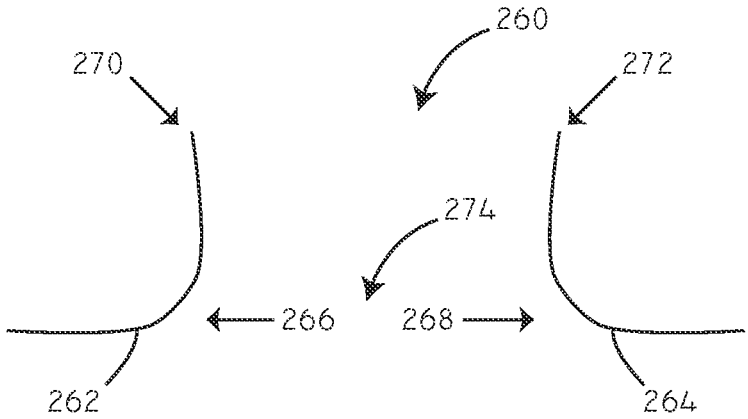
FIG. 6 is a cross-sectional schematic view of a two flaps in an open configuration.

Referring now to FIG. 5, a cross-sectional schematic view of a portion of a handle 260 is shown. The handle includes a first flap 262 and a second flap 264. In this view, the first flap 262 and second flap 264 are in a closed configuration, substantially planar with the rest of the bag (not shown). As described above, the flaps can flex outwardly. Referring now to FIG. 6, a cross-sectional schematic view of a portion of the handle 260 is shown in an open configuration. In the open configuration, the flaps have flexed such that the cut ends (270 and 272) of the first flap 262 and second flap 264 are now pointed away from the region 274 in between the two flaps 262 and 264. This can occur, for example, in response to a user inserting their hand into the region 274 in between the two flaps 262 and 264. In the open configuration, a user's hand can support the weight of a bag through contact with the portions 266 and 268 of the flaps 262 and 264 connected to the rest of the bag. As such, in the open configuration, the user need not support the weight of a bag through contact with cut edges, thereby increasing comfort for the user.

Figure 7:
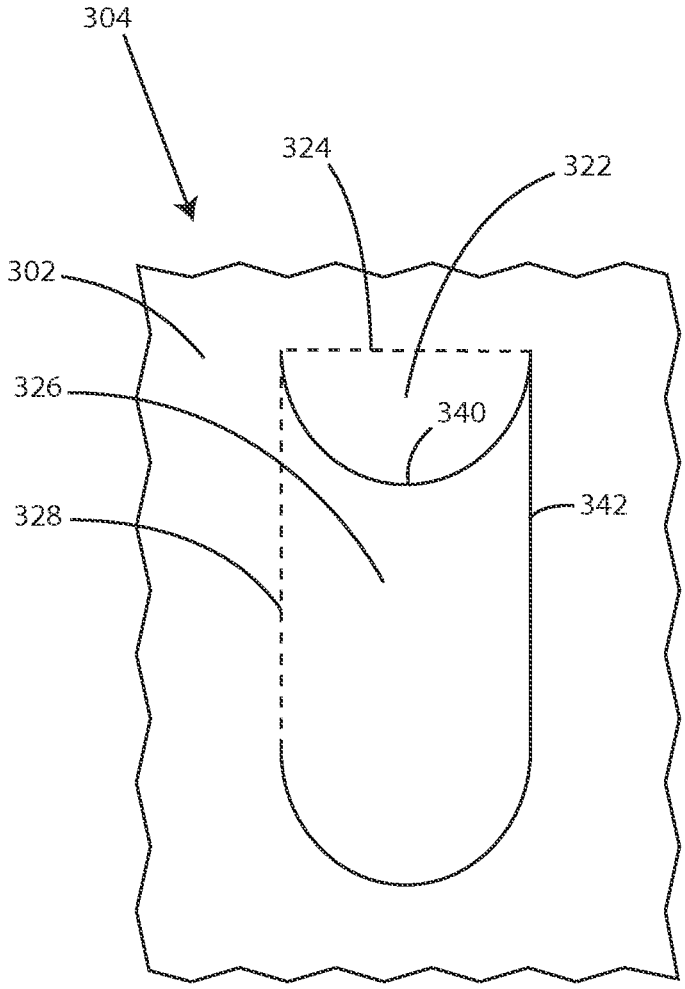
FIG. 7 is a schematic view of a handle region shown in accordance with another embodiment of the invention.

It will be appreciated that the cut lines in the handle region can be formed in various ways including die-cutting, laser-cutting, thermal-cutting, and the like. It will also be appreciated that the precise pattern of cut lines can take on many different forms. Referring now to FIG. 7, a schematic view of a handle region is shown in accordance with another embodiment of the invention. In this embodiment, the handle region 304 includes a first flap 322 and a second flap 326. The flaps 322, 326 are formed in part through a first cut line 340 and a second cut line 342. The cut lines 340, 342 enable the flaps 322, 326 to flex along lines 324 and 328 respectively. In use, a user's hand (not shown) would be inserted into the handle region 304 and the weight of the article would be supported by the user's hand along flex line 324 of the first flap 322 and along flex line 328 of the second flap 326.

Figure 8:
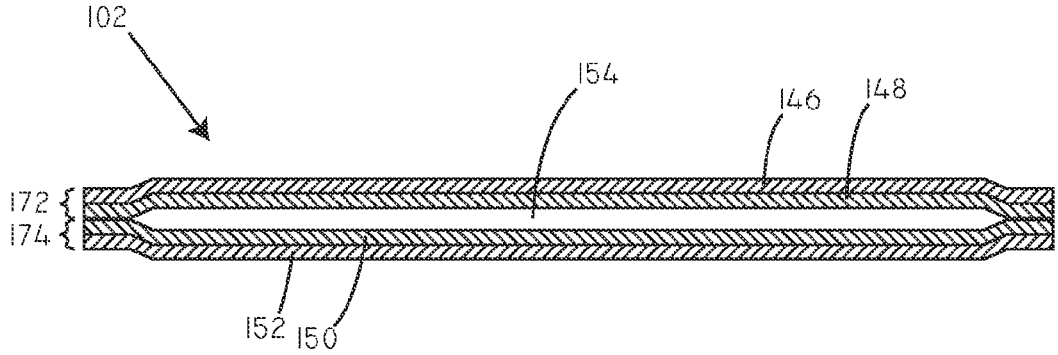
FIG. 8 is a cross-sectional view (not to scale) of an article as taken along line 8-8 of FIG. 1.

In some embodiments of the invention, a reinforcing material is disposed in between two separate laminate sheets in order to provide extra strength in the handle region. Referring now to FIG. 8, a cross-sectional view (not to scale) of an article in accordance with an embodiment of the invention is shown as taken along line 8-8 of FIG. 1. In this view, a first laminate 172 and a second laminate 174 are configured such that the edges of the laminates are coupled to one another. This coupling can be achieved using various techniques including the use of adhesives, heat-sealing, sonic welding, and the like. Each laminate can include multiple layers of material. By way of example, first laminate 172 can include a first layer 146 and a second layer 148. The first layer 146 can include polyester, polyethylene, polypropylene, polyamide, and/or alloys including the same and the second layer 148 can include polyethylene or polyethylene alloys. Similarly, second laminate 174 can include a first layer 152 and a second layer 150. The first layer 152 can include polyester, polyethylene, polypropylene, polyamide, and/or alloys including the same and the second layer 150 can include polyethylene or polyethylene alloys. Together, the first layer 146 and the second layer 148 can define an interior volume 154. It is within the interior volume 154 that the article can contain a product, such as a dry particulate material (not shown).

Figure 9:
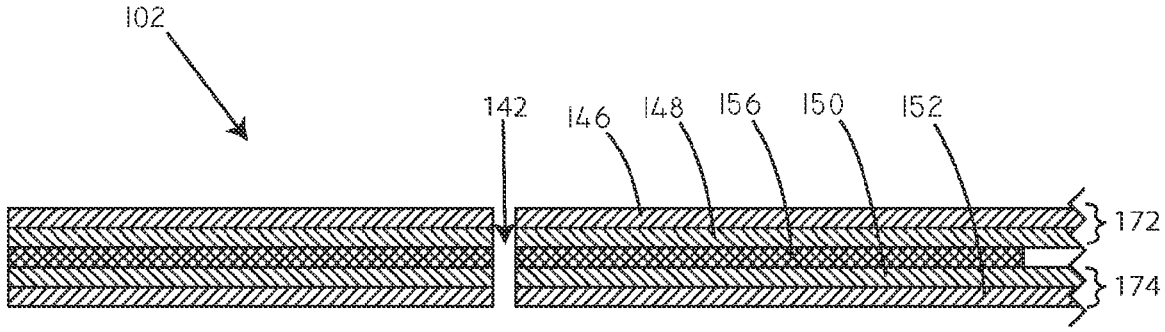
FIG. 9 is a cross-sectional view (not to scale) of an article as taken along line 9-9 of FIG. 1.

However, in the handle region, the article may include an additional layer of material in some embodiments. Referring now to FIG. 9, a cross-sectional view (not to scale) of an article is shown as taken along line 9-9 of FIG. 1. Cut line 142 is also shown in this cross-sectional view. In this view, a support layer 156 is disposed in between the first laminate 172 and the second laminate 174. In some embodiments the support layer 156 can be composed of a material that can be heat sealed to both the second layer of the 148 of the first laminate 172 and the second layer 150 of the second laminate 174. In this configuration, the support layer 156 can strengthen and reinforce the handle region, making it less likely to tear or rupture. This can be particularly important in the context of articles that have multiple cut lines, such as that shown in FIG. 1 and FIG. 7 since additional cut lines create additional points where a tear can begin. Reinforcement can be important as in some embodiments the bag may be configured to carry an amount of a product exceeding 10 pounds in weight. In some embodiments, the bag may be configured to carry an amount of a product exceeding 20 pounds in weight. In some embodiments, the bag may be configured to carry an amount of a product exceeding 30 pounds in weight. In some embodiments, the bag may be configured to carry an amount of a product exceeding 40 pounds in weight.

Figure 10:
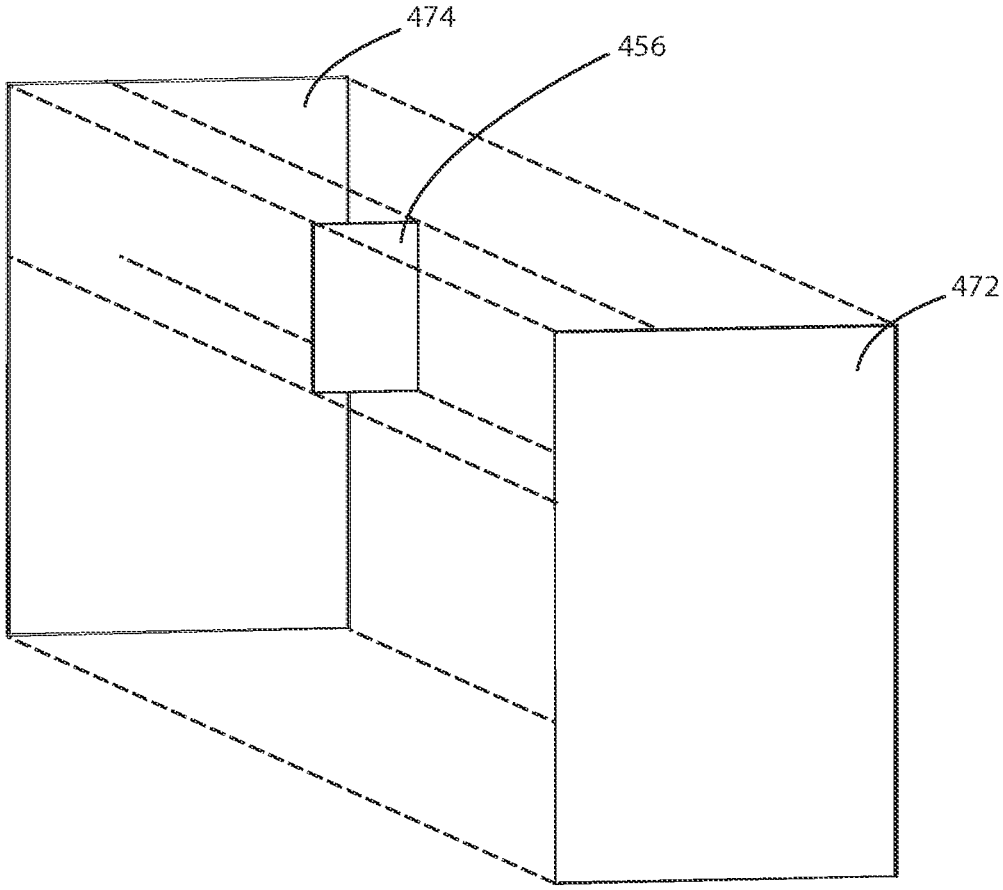
FIG. 10 is an exploded view of a support layer disposed between a first sheet and a second sheet in accordance with an embodiment of the invention.

FIG. 10 is an exploded view of a support layer 456 disposed between a first sheet 472 and a second sheet 474. In some embodiments, the first sheet 472 and the second sheet 474 can comprise laminates. The first sheet 472, the support layer 456, and the second sheet 474 can all be bonded together in order to make an article such as a bag for particulate material.

Figure 11:
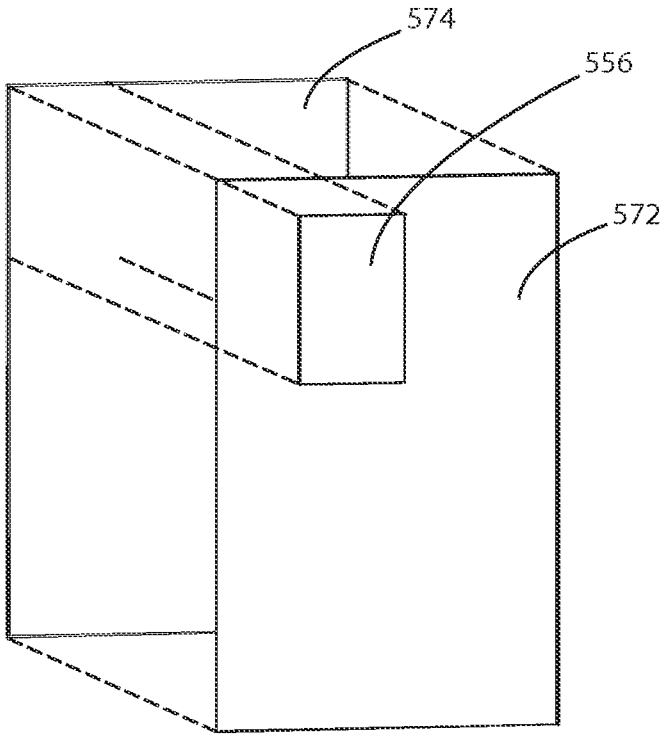
FIG. 11 is an exploded view of a support layer disposed outside of a first sheet and a second sheet in accordance with an embodiment of the invention.

However, a support layer can also be disposed on the outside of the first sheet and the second sheet. FIG. 11 is an exploded view of a support layer 556 disposed outside of a first sheet 572 and a second sheet 574. The support layer 556, the first sheet 572, and the second sheet 574 can all be bonded together in order to make an article such as a bag for particulate material.

Figure 12:
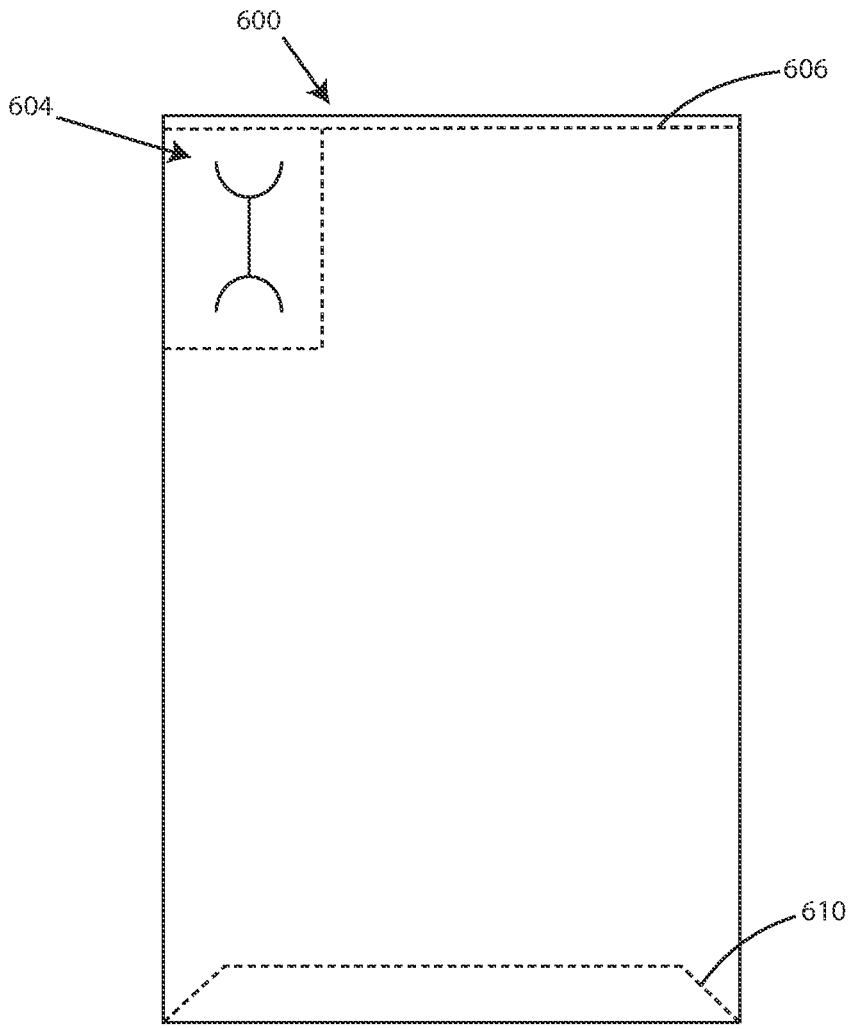
FIG. 12 is a schematic view of an article in accordance with another embodiment of the invention.

Embodiments of the invention can also include various other features in order to facilitate their use. By way of example referring now to FIG. 12, an article 600 is shown including a handle region 604. The article also includes an opening strip 606 disposed across the top edge of the article 600. The opening strip 606 can be removed in order to facilitate the opening of the article 600. In some embodiments, the opening strip 606 can include a perforation line in order to facilitate removal of the opening strip 606. In some embodiments, the article can also include a reclosure mechanism (not shown) such as a compression seal in order to facilitate reclosure of the article after removal of the opening strip 606. In some embodiments, the article 600 can also be configured to include one or more gussets 610 in order to facilitate expansion of the interior volume of the bag in order to hold dry particulate matter.

Figure 13:
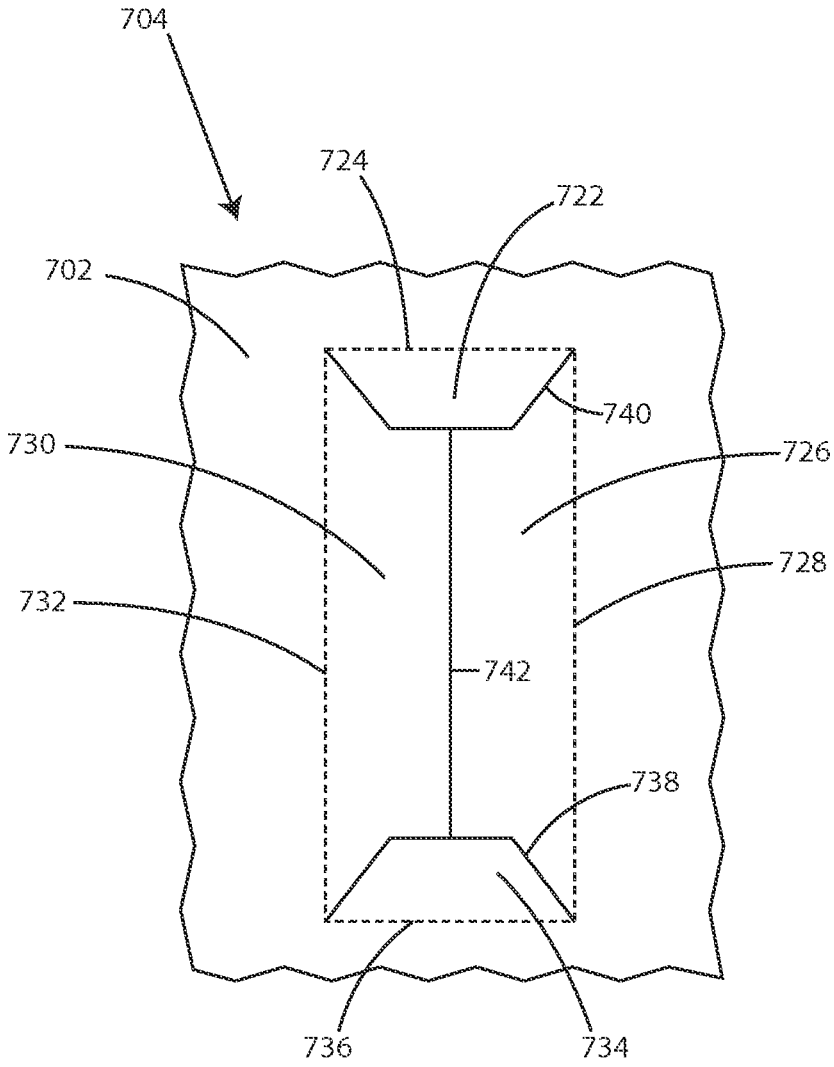
FIG. 13 is a schematic view of the handle region of an article in accordance with another embodiment of the invention.

It will be appreciated that handle regions having multiple flaps in accordance with embodiments herein can take on many different configurations. While not intending to be bound by theory, it is believed that there can be various manufacturing advantages associated with configurations wherein the flaps can be formed by die-cutting along lines that are not curved. For example, it can be easier to maintain the sharpness of a die that only needs to cut along straight line segments as opposed to curved line segments. Referring now to FIG. 13, an enlarged schematic view of the handle region 704 is shown in accordance with another embodiment herein. The handle region 704 can be configured to facilitate comfortable gripping of the article 702. In some embodiments, the handle region 704 can include cut lines 738, 740, and 742 that allow multiple flaps of material to flex away when a person's hand is inserted into the handle, creating a tactile feeling of increased comfort for the bag user. Cut lines 738, 740, and 742 can allow flaps 722, 726, 730, and 734 to move independently from one another. For example, when a person's hand is inserted, flap 722 can bend away from the plane of the body 702 along a first axis (line 724) and flap 726 can bend away from the body 702 along a second axis (line 728). In some embodiments, the first axis can be perpendicular to the second axis. Flap 730 can bend away from the body 702 along a third axis (line 732) and flap 734 can bend away from the body 702 along a fourth axis (line 736). In use, the weight of the bag will be supported by the user's hand through contact with the non-cut edge of the flaps that is still connected to the rest of the bag (e.g., the user's hand will support the weight by contact with the bag along one or more of the first axis, second axis, third axis, and fourth axis). In this manner, the flaps 722, 726, 730, and 734 can serve to prevent the user's hand from supporting the weight of the bag through contact with a cut-edge of the material of the body 702, thereby increasing comfort.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

The invention claimed is:

1. An article for holding a dry particulate product, the article comprising:

a first sheet;

a second sheet coupled to the first sheet defining an interior volume between the first sheet and the second sheet; and a handle region defining an aperture passing through the first sheet and the second sheet, the handle region having flaps, the flaps consisting of a first flap and a second flap, the first flap coupled to the first sheet and the second sheet along a first axis, the second flap coupled to the first sheet and the second sheet along a second axis, the first axis and second axis perpendicular to one another, the first flap and the second flap configured to flex away from the handle region, the first flap separated from the second flap by a cut line through the first and second sheet allowing the first flap and second flap to move independently from one another;

the first sheet and the second sheet each comprising four edges and four corners, the handle region disposed in one of the four corners, the first axis disposed along a first edge of the aperture adjacent to the corner and second axis disposed along a second edge of the aperture adjacent to the corner;

the first flap and second flap together occluding the entire area of the aperture when not flexed away from the handle region wherein when the first flap and second flap are flexed away from the handle region at least a portion of the first flap or at least a portion of the second flap extends through the aperture through the first sheet and the second sheet.

2. The article of claim 1, wherein the first flap and second flap are die-cut.

3. The article of claim 1, the handle region separated from the interior volume by a seam coupling the first sheet to the second sheet.

4. The article of claim 1, the first sheet comprising a laminate of a first material and a second material.

5. The article of claim 1, the second sheet comprising a laminate of a first material and a second material.

6. The article of claim 1, the first sheet and the second sheet coupled to one another by a perimeter seam.

7. The article of claim 1, further comprising a reinforcement layer coupled to the first sheet in the handle region.

8. The article of claim 1, further comprising a reinforcement layer disposed between the first sheet and the second sheet in the handle region.

9. A bag comprising:

a first sidewall;

a second sidewall coupled to the first sidewall defining an interior volume between the first sheet and the second sheet; and a die-cut handle having flaps, the flaps consisting of a first flap and a second flap, the first flap coupled to the first sidewall and the second sidewall along a first axis, the second flap coupled to the first sidewall and the second sidewall along a second axis, the first axis and second axis perpendicular to one another, wherein the first and second flaps are configured to flex between a closed position where the flaps are substantially planar with the first and second sidewall and an open position where the flaps are not-planar the first and second sidewall, the first flap separated from the second flap by a cut line through the first and second sheet allowing the first flap and second flap to move independently from one another;

wherein the first flap and second flap together entirely occlude an aperture passing through the first sidewall and the second sidewall in the area of the die-cut handle when in the closed position wherein when the first flap and second flap are in the open position at least a portion of the first flap or at least a portion of the second flap extends through the aperture through the first sidewall and the second sidewall.

10. An article for holding a product, the article comprising:

a first sheet;

a second sheet coupled to the first sheet defining an interior volume between the first sheet and the second sheet; and a handle region defining an aperture passing through the first sheet and the second sheet, the handle region having flaps, the flaps consisting of a first flap and a second flap, the first flap coupled to the first sheet and the second sheet along a first axis, the second flap coupled to the first sheet and the second sheet along a second axis, the first axis and second axis perpendicular to one another, the first flap defined by a first arcuate cut line, and the first axis, the second flap defined by the first arcuate cut line, a second arcuate cut line and the second axis, the first flap and the second flap configured to flex away from the handle region, the first flap separated from the second flap by the first arcuate cut line through the first and second sheet allowing the first flap and second flap to move independently from one another;

the first axis disposed in the direction of a line connecting a first point and a second point;

wherein the first arcuate cut line starts at the first point and ends at the second point;

the second axis disposed in the direction of a line connecting the first point and a third point;

wherein the second arcuate cut line starts at the third point and ends at the second point;

the first sheet and the second sheet each comprising four edges and four corners, the handle region disposed in one of the four corners, the first axis disposed along a first edge of the aperture adjacent to the corner and second axis disposed along a second edge of the aperture adjacent to the corner;

the first flap and second flap together occluding the entire area of the aperture when not flexed away from the handle region; and when the first flap and second flap are flexed away from the handle region at least a portion of the first flap or at least a portion of the second flap extends through the aperture through the first sheet and the second sheet.

* * * * *